US008510903B2

(12) United States Patent
Jubner et al.

(10) Patent No.: US 8,510,903 B2
(45) Date of Patent: Aug. 20, 2013

(54) VACUUM CLEANER COMPRISING A FIRST AND SECOND LID

(75) Inventors: Alexander Jubner, Stockholm (SE); Christer Engström, Åkersberga (SE)

(73) Assignee: AB Electrolux, Stockholm (SE)

( * ) Notice: Subject to any disclaimer, the term of this patent is extended or adjusted under 35 U.S.C. 154(b) by 219 days.

(21) Appl. No.: 13/001,471

(22) PCT Filed: Jun. 15, 2009

(86) PCT No.: PCT/SE2009/000300
§ 371 (c)(1),
(2), (4) Date: Mar. 21, 2011

(87) PCT Pub. No.: WO2009/157838
PCT Pub. Date: Dec. 30, 2009

(65) Prior Publication Data

US 2011/0185534 A1 Aug. 4, 2011

Related U.S. Application Data

(60) Provisional application No. 61/077,055, filed on Jun. 30, 2008.

(30) Foreign Application Priority Data

Jun. 27, 2008 (SE) ..... 0801518

(51) Int. Cl.
*A47L 5/00* (2006.01)

(52) U.S. Cl.
USPC ..... 15/327.2; 15/323

(58) Field of Classification Search
USPC ..... 15/327.1, 327.2, 327.7, 323; 16/355, 16/362, 363
See application file for complete search history.

(56) References Cited

U.S. PATENT DOCUMENTS

| | | | | |
|---|---|---|---|---|
| 4,554,700 | A | 11/1985 | Lyman | |
| 7,472,453 | B2 * | 1/2009 | Mersmann et al. | 15/319 |
| 7,644,471 | B2 * | 1/2010 | Bott et al. | 15/323 |
| 2003/0208874 | A1 * | 11/2003 | Steffen et al. | 15/323 |
| 2008/0271280 | A1 * | 11/2008 | Tiede et al. | 15/323 |

FOREIGN PATENT DOCUMENTS

| | | | |
|---|---|---|---|
| DE | 8010164 | U1 | 8/1981 |
| EP | 0382925 | A1 | 8/1990 |
| EP | 0319831 | B1 | 5/1991 |
| EP | 1082937 | | 3/2001 |
| EP | 1010388 | B1 | 1/2010 |
| JP | 4256715 | A | 9/1992 |

* cited by examiner

*Primary Examiner* — Dung Van Nguyen
(74) *Attorney, Agent, or Firm* — Hunton & Williams LLP

(57) ABSTRACT

The invention relates to a vacuum cleaner, comprising a first lid (3), which closes a first compartment (4), and a second lid (5), which closes a second compartment (6). The lids are combined such that the first lid is part of and the first compartment is accommodated inside the second lid. The first and the second lids (3, 5) are separately openable by means of one common actuator (9) of a locking mechanism.

17 Claims, 5 Drawing Sheets

VACUUM CLEANER COMPRISING A FIRST AND SECOND LID

The invention relates to a vacuum cleaner, comprising a first lid, which closes a first compartment, and a second lid, which closes a second compartment, wherein the lids are combined such that the first lid is part of and the first compartment is accommodated inside the second lid.

BACKGROUND OF THE INVENTION

Vacuum cleaners are becoming smaller and more compact and at the same time the trend goes towards more bevelled design forms, which has to effect that the proportion of sloping surfaces will be quite large. In this way, the available room for positioning lids, controls and the like, on the outer surface of the vacuum cleaner will become more limited. Accordingly, there is a need for new solutions for combining two or more functions in one device or unit in order to save space.

Through EP 0319831 is disclosed a push button for a vacuum cleaner which has two functions. More precisely, the push button has the form of a large plate and when pressing one side of the push button, an electric switch will be operated to the on or off state, whereas when pressing the other side of the push button, a locking device for a cable roller will be released enabling automatic rolling in of the electric cable. However, a push button of this kind is not at all space saving but will instead take up a considerable space on the surface of the vacuum cleaner. This is due to the fact that the push button has not the character of being a single unit, which has been given two functions, but is more like two separate units, which have been combined into one larger unit.

EP 1010388 discloses a vacuum cleaner having a handle, which is pivotable between a retracted position, when the handle is flush with the upper surface of the vacuum cleaner and closes an accessory lid, and an extended position when the handle projects from the vacuum cleaner and can be utilized to carry the vacuum cleaner. Apart from this, the handle is arranged to initiate different functions at different positions of the handle. In the document is mentioned switching on/off, release of a cable reel brake, opening and closing of an accessory lid and/or a dust compartment lid.

U.S. Pat. No. 4,554,700 discloses a vacuum cleaner, which comprises two lids, one first lid for closing an accessory compartment for accommodating supplementary nozzles and the like and a second lid for closing a dust collecting compartment. These two lids are combined such that the accessory lid is part of the dust compartment lid and the accessory compartment is accommodated in the dust compartment lid. In this document is not disclosed in detail how the respective lids are locked in the closed position. However, if the latch means for locking the lids in the closed position are in form of snap locking, there is the risk that when opening the first lid, the second lid will be opened instead. If the latch means, on the other hand, are formed as mechanically locking devices, two similar locking devices has to be provided which will be costly to produce and will take up considerable space on the vacuum cleaner.

SUMMARY OF THE INVENTION

It is an object of the invention to provide a vacuum cleaner having at least two lids, each for closing a separate compartment, the locking means of which are arranged in a cost and space saving way. At least this object is achieved by a vacuum cleaner according to claim 1.

The basis of the invention is the insight that this object may be achieved by forming the vacuum cleaner such that the first and the second lids are separately lockable by means of a common locking mechanism by means of which each lid can be separately released by operating the actuator in different ways.

Within this general idea, the invention may be implemented in many different ways. The compartments can be any arbitrary and in a hereinafter described and illustrated embodiment, the first compartment is an accessory compartment for accommodating accessories, such as supplementary nozzles, whereas the second compartment is a dust collecting compartment. More precisely, when the actuator is pushed, a first lid covering an accessory compartment will be opened, where accessories such as different nozzles can be stored, whereas when pulling the actuator, a second lid to a dust collecting compartment will be opened in order to allow replacement of a dust bag. It is to be understood, however, that the respective lids could be opened by operating the actuator also in other suitable ways.

The locking mechanism for achieving this can be formed in many different ways. In the hereinafter described and illustrated embodiment, the locking mechanism comprises an actuator and a sub-actuator. The actuator is rotatable around a first axis on the sub-actuator, which in its turn is rotatable around a second axis on the second lid. The actuator has a hook formation, which in a locked state is in engagement with a hook formation on the first lid, whereas the sub-actuator has a hook formation, which in a locked state is in engagement with a hook formation on the body of the vacuum cleaner. When the actuator is operated in one direction, it will be rotated around the first axis and the hook formation on the actuator will be disengaged from the first lid, which accordingly can be opened. When the actuator on the contrary is operated in the other direction, the hook formation on the actuator will maintain engagement with the first lid. Instead the sub-actuator will be rotated around the second axis and the hook formation on the sub-actuator will be disengaged from the body, such that the second lid can be opened.

BRIEF DESCRIPTION OF THE DRAWINGS

The invention will be described more in detail in a hereinafter detailed description of an exemplary embodiment with reference to the accompanying drawings, in which.

DETAILED DESCRIPTION OF AN EMBODIMENT OF THE INVENTION

Figure 1:
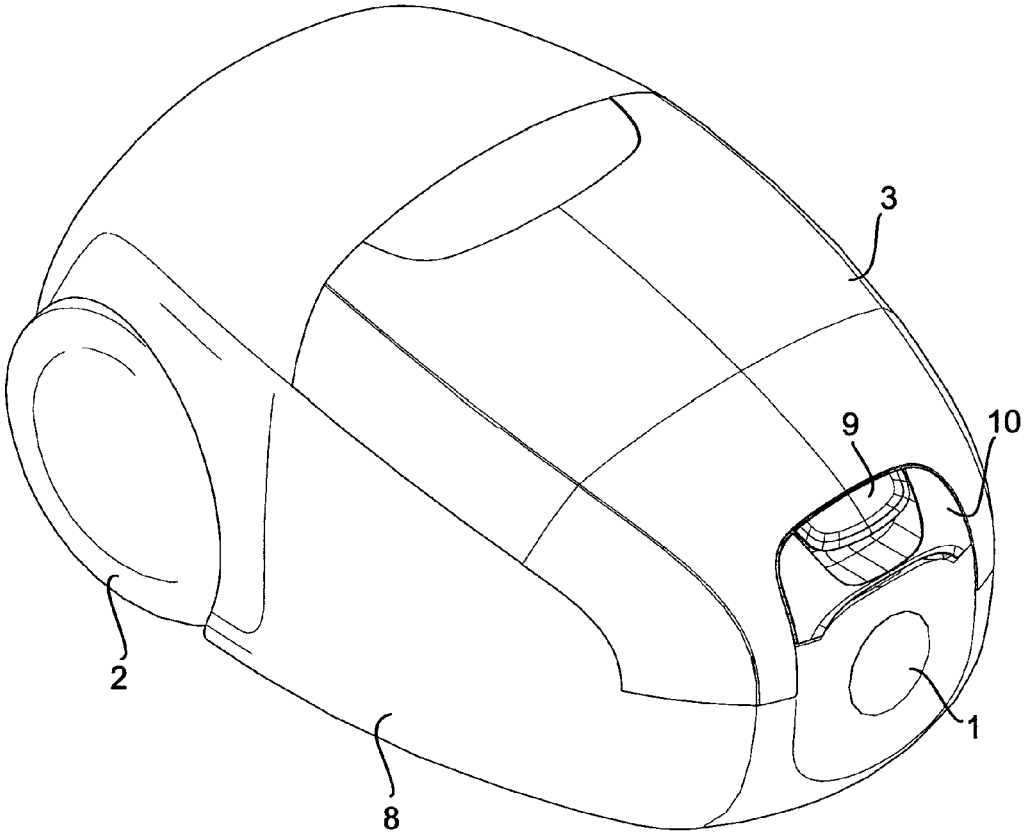
FIG. 1 is a perspective view of the exterior of a vacuum cleaner according to the invention.

Reference is first made to FIG. 1 of the drawings, in which is illustrated, in a perspective view, the outer appearance of a vacuum cleaner constructed in accordance with the present invention. The vacuum cleaner comprises a suction opening 1, into which a not shown hose and tube, being provided with a suction nozzle in the outer end, is connectible in a way known in the art. The vacuum cleaner is moreover provided with wheels 2 for facilitating moving of the vacuum cleaner over a floor or the like to be cleaned.

Figure 2:
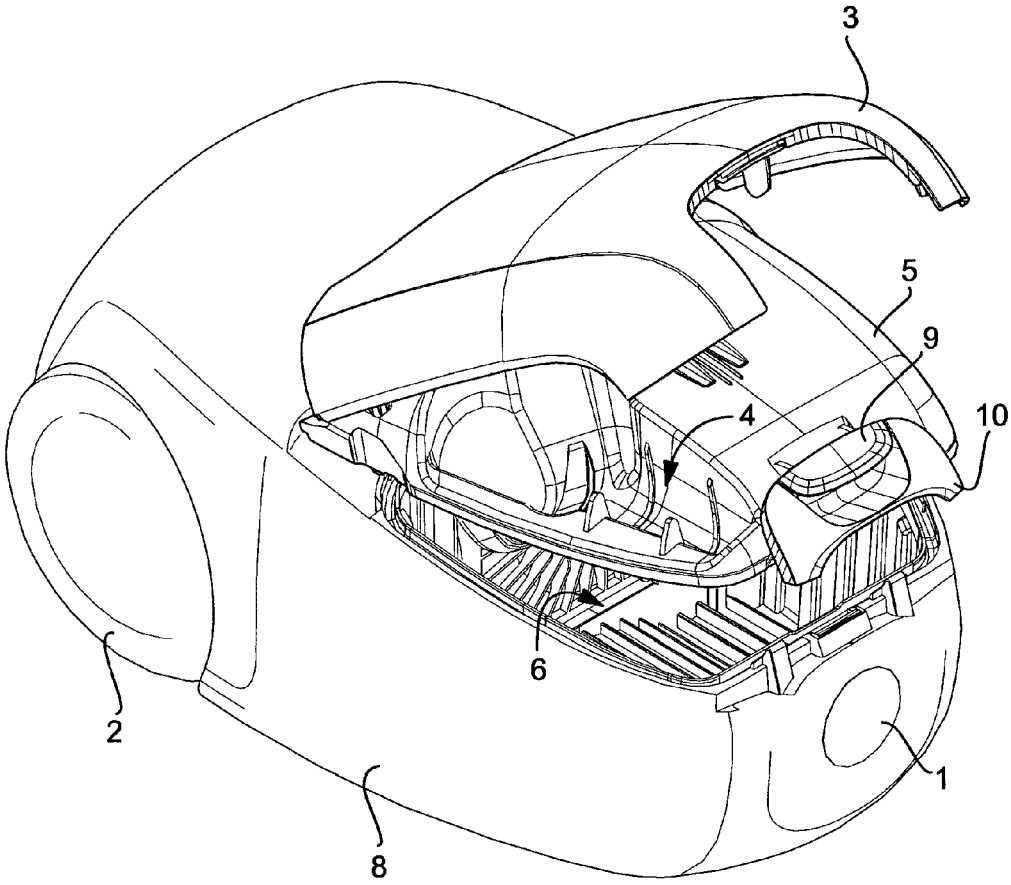
FIG. 2 is a perspective view according to FIG. 1 with a first and a second lid in opened positions.

On the upper side, the vacuum cleaner has an openable first lid 3, which can be opened, as is illustrated in FIG. 2. The first lid is an accessory lid for allowing closing and access to an accessory compartment 4, in which accessories, such as supplementary suction nozzles, can be accommodated. The accessory compartment is in its turn accommodated in a second lid 5, which is a dust compartment lid for allowing closing and access to a dust collecting compartment 6. During operation, dust and debris from the surfaces to be cleaned, is drawn by means of an air flow through the suction nozzle, the tube and the hose, in through the suction opening 1 to the dust collecting compartment 6 where it is collected in a not shown dust bag in a way known in the art.

Figure 3:
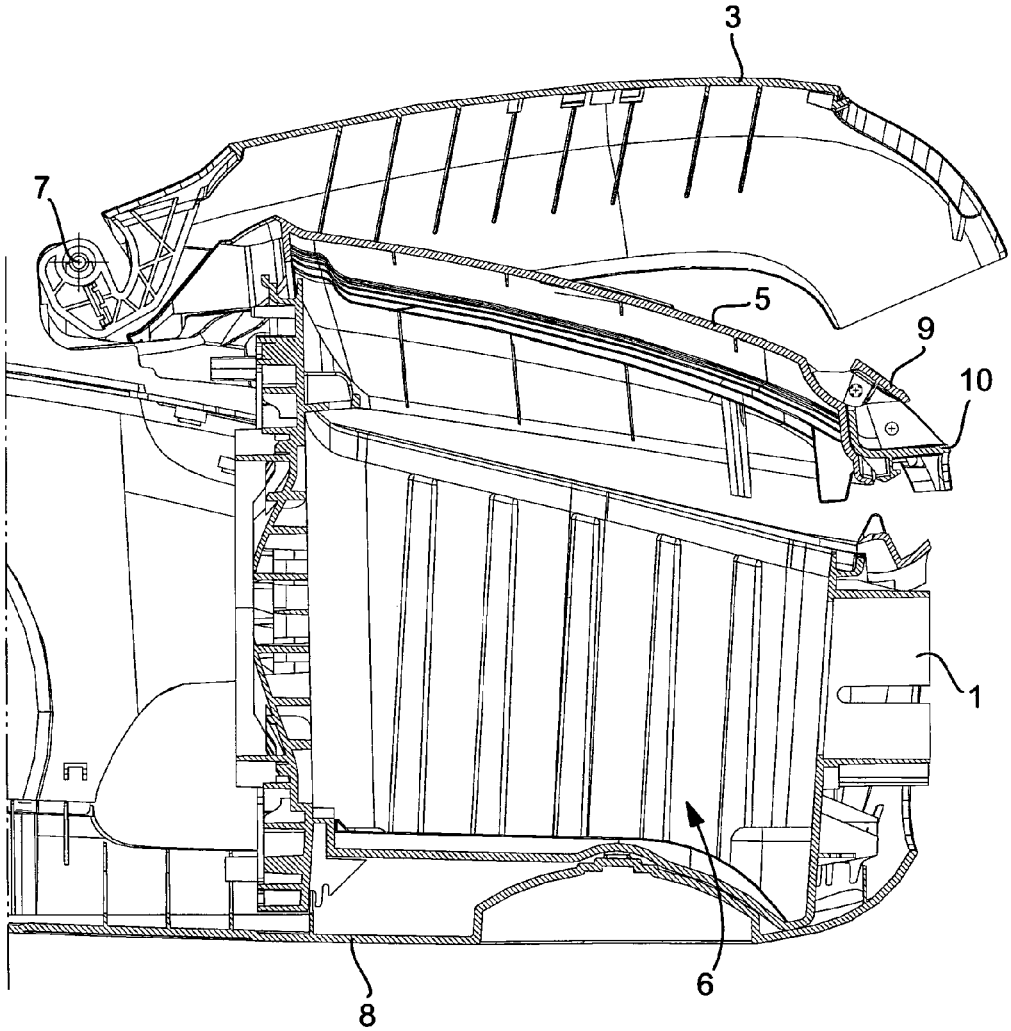
FIG. 3 is a longitudinal section through a front portion of the vacuum cleaner having the first and second lids opened.

Reference is then made to FIG. 3, which is a longitudinal section through the forward portion of the vacuum cleaner including the first and second lids 3 and 5, which are shown in the opened state according to FIG. 2. Both of the lids are hinged around a common axis 7, i.e. around this axis the first lid 3 is pivotable in relation to the second lid 5, which in its turn is pivotable in relation to a body 8 of the vacuum cleaner. According to the invention, both of the lids 3 and 5 are lockable as well as releasable by means of a common actuator 9. The actuator 9 is part of a releasing and locking mechanism, which is mounted on the second lid 5 and which further comprises a sub-actuator 10. More precisely, the actuator 9 is rotatably mounted, around a first rotary axis 11, on the sub-actuator 10, which in its turn is rotatably mounted, around a second rotary axis 12, on the second lid 5. Moreover, the actuator 9 is formed with a hook formation 13, which is in engagement with a complementary hook formation 14 on the first lid 3 in its locked state. Also the sub-actuator 10 is formed with a hook formation 15 which, in the locked position of the second lid 5, is in engagement with a hook formation 16 in the body 8.

Figure 4:
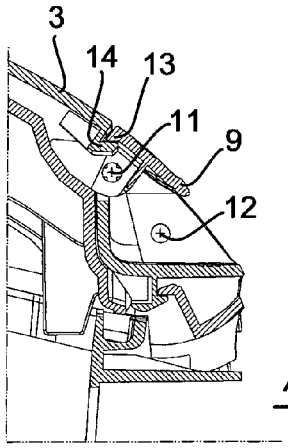
FIG. 4 is a longitudinal section through a locking mechanism for the lids in an initial position with both of the lids locked.

In FIG. 4 the releasing and locking mechanism is shown in an initial position with the hook formation 13 of the actuator 9 in engagement with the hook formation 14 of the first lid 3, such that the first lid is in a locked position on the second lid 5. In a similar way, the hook formation 15 of the sub-actuator 10 is in engagement with the hook formation 16 of the body 8, such that the second lid 5 is in a locked position on the body 8.

Figure 6:
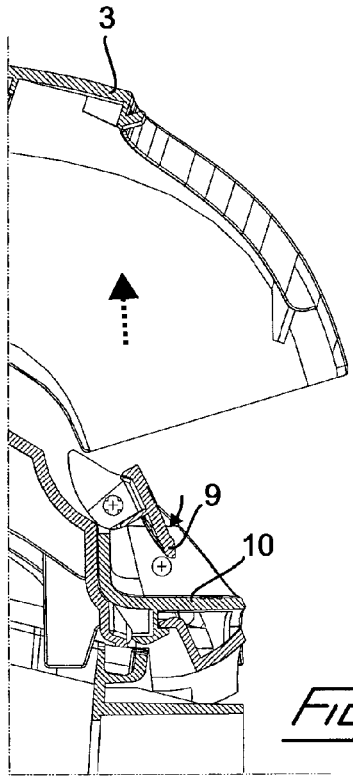
FIG. 6 is a longitudinal section through the locking mechanism for the lids in the position according to FIG. 5 with the first lid being lifted.
Figure 5:
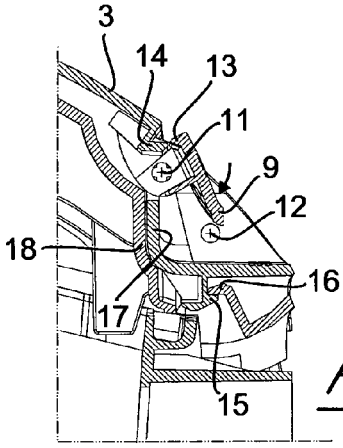
FIG. 5 is a longitudinal section through the locking mechanism for the lids with an actuator operated for releasing the first lid.

In FIG. 5, a lower portion of the actuator 9 has been depressed such that the actuator is somewhat rotated clockwise, as seen in the drawing, around the first rotary axis 11. In this position the hook formation 13 of the actuator 9 will go out of engagement with the hook formation 14 of the first lid 3. However, the hook formation 15 of the sub-actuator will be maintained in engagement with the hook formation 16 due to contact between a vertical wall portion 17 of the sub-actuator and a vertical wall portion 18 of the second lid 5. The vertical wall portion 18 will accordingly prevent the sub-actuator from rotating counter-clockwise, as seen in FIG. 5, which the depressing force on the actuator 9 is striving to do. Accordingly, the first lid 3 can be raised for access to the accessory compartment, as is illustrated in FIG. 6, while the second lid 5 will continue to be locked to the body 8.

Figure 8:
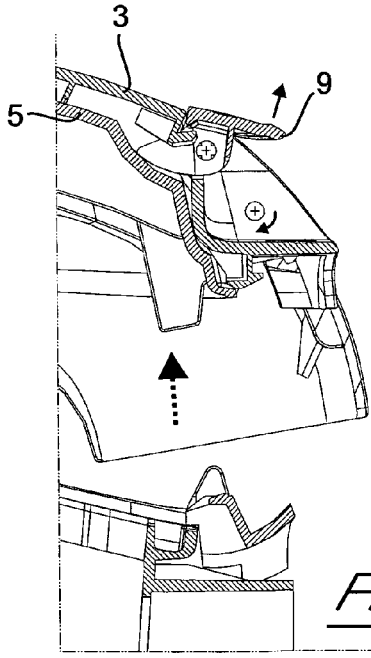
FIG. 8 is a longitudinal section through the locking mechanism for the lids in the position according to FIG. 7 with the second lid being lifted.
Figure 7:
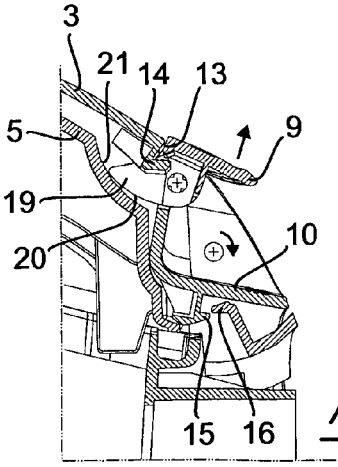
FIG. 7 is a longitudinal section through the locking mechanism for the lids with the actuator operated for releasing the second lid.

The function of the locking mechanism when opening the second lid 5 is illustrated in FIG. 7. In this case the actuator 9 is lifted such that it rotates counter-clockwise around the axis 11. The actuator 9 is formed with a pair of inward extending brackets 19, which on the lower side are provided with convexly shaped surfaces 20, which is in contact with a concavely shaped surface 21 on the second lid 5. When lifting the actuator 9, as is illustrated in FIG. 7, the convex surfaces 20 of the brackets 19 will abut and slide against the concave surface 21, such that the axis 11 of the actuator 9 is somewhat lifted. The sub-actuator 10 will accordingly be somewhat rotated in the clockwise direction around the axis 12. This has to effect that the hook formation 15 of the sub-actuator 10 will be disengaged from the hook formation 16 of the body 8. The second lid 5 is then free to be opened, as is illustrated in FIG. 8, while the first lid 3 is still in locked engagement with the second lid 5.

Figure 9:
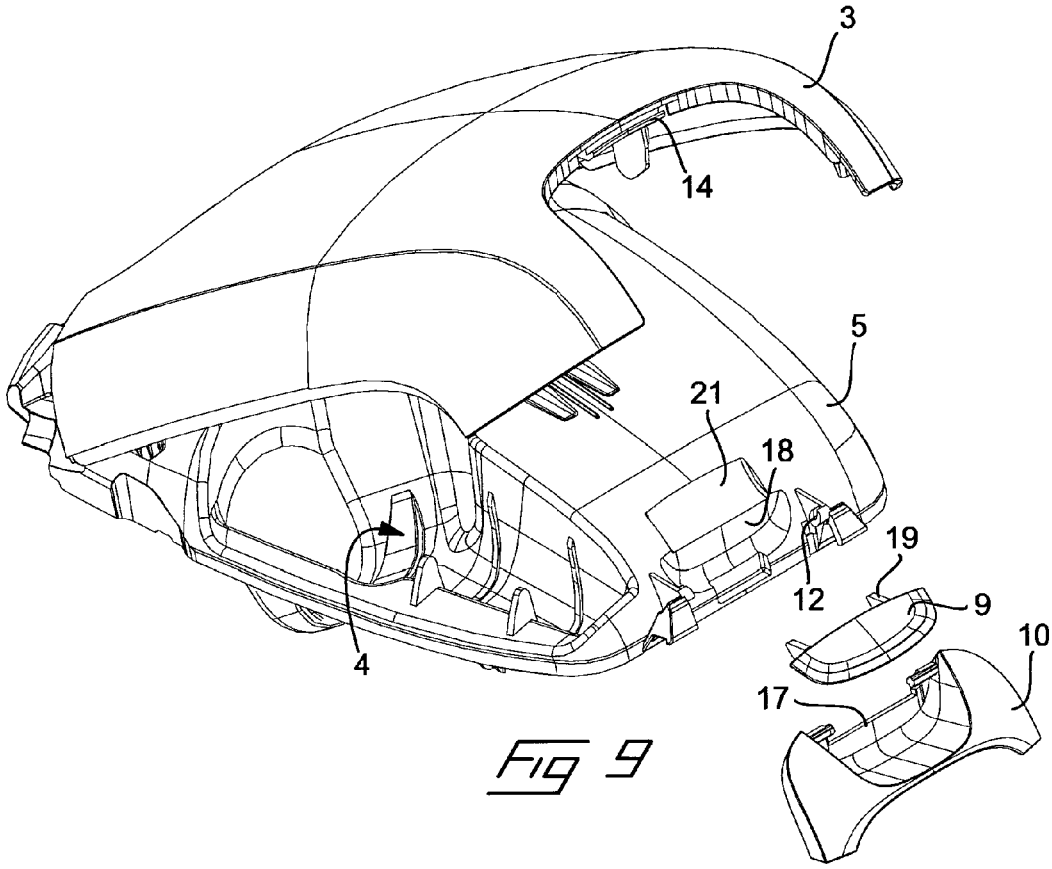
FIG. 9 is an exploded perspective view of the first and second lids as well as the actuator and a sub-actuator.
Figure 10:
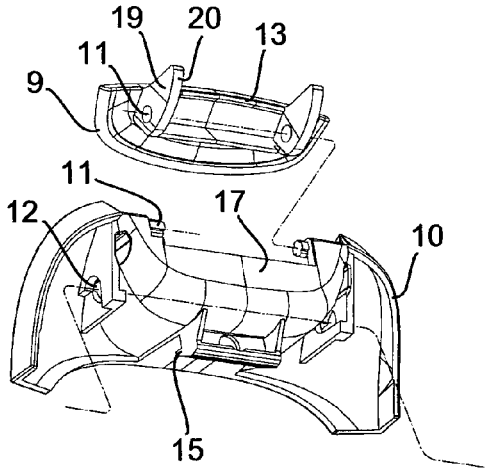
FIG. 10 is an exploded perspective view of the actuator and sub-actuator as seen from the inner side.

Reference is then made to the exploded perspective views of FIGS. 9 and 10, in which the actual shape of the parts constituting the locking mechanism are better visible. Here are shown the actuator 9 as well as the sub-actuator 10, the hook formation 13 of the actuator, the hook formation 14 of the first lid 3, and the hook formation 15 of the sub-actuator 10, the vertical wall portion 17 of the sub-actuator, the vertical wall portion 18 of the second lid, the brackets 19 of the actuator having convexly shaped surfaces 20 on the lower sides, and the concavely shaped surface 21 on the second lid. Also visible here are pins and holes forming the rotary axis 11 and 12 between the actuator 9 and the sub-actuator 10 as well as between the sub-actuator and the second lid 5, respectively.

The invention claimed is:

1. A vacuum cleaner, comprising a first lid, that closes a first compartment, and a second lid, that closes a second compartment, wherein the lids are combined such that the first lid is part of the second lid, and the first compartment is accommodated inside the second lid, wherein the first and the second lids are separately openable by means of one common actuator of a locking mechanism.

2. A vacuum cleaner according to claim 1, wherein the locking mechanism functions to open one of the lids when the actuator is pushed and the other lid when the actuator is pulled.

3. A vacuum cleaner according to claim 1, wherein the locking mechanism comprises a sub-actuator, wherein the actuator is rotatably mounted on the sub-actuator while the sub-actuator is rotatably mounted on the second lid.

4. A vacuum cleaner according to claim 1, wherein the actuator is provided with a hook formation, which in the locked state is in engagement with a hook formation on the first lid.

5. A vacuum cleaner according to claim 4, wherein the sub-actuator is provided with a hook formation, which in the locked state is in engagement with a hook formation on a body of the vacuum cleaner.

6. A vacuum cleaner, comprising:

a housing having a first compartment therein;

a first lid pivotally connected to the housing between a closed first lid position in which the first lid encloses the first compartment, and an open first lid position in which the first lid opens the first compartment;

a second lid pivotally connected to the first lid;

a second compartment formed between the first lid and the second lid, wherein the second lid is pivotal on the first lid between a closed second lid position in which the second lid closes the second compartment, and an open second lid position in which the second lid opens the second compartment;

a lock configured to separately and selectively lock the first lid in the closed first lid position and the second lid in the closed second lid position, the lock being pivotally connected to the first lid and comprising:

a first latch selectively connected to the housing; and a second latch selectively connected to the second lid.

7. The vacuum cleaner of claim 6, wherein the first lid and the second lid pivot about the vacuum cleaner housing about a common pivot axis.

8. The vacuum cleaner of claim 6, wherein the lock comprises a first actuator pivotally mounted about a first axis to the first lid, and a second actuator pivotally mounted about a second axis to the first actuator.

9. The vacuum cleaner of claim 8, wherein the first latch is located on the first actuator, and the second latch is mounted on the second actuator.

10. The vacuum cleaner of claim 9, wherein the second latch and the second pivot axis are positioned such that application of a first force in a first direction on the second actuator causes the second actuator to pivot about the second pivot axis to thereby release the second latch from the second lid.

11. The vacuum cleaner of claim 10, wherein the first hook and the first pivot axis are positioned such that application of a second force in a second direction on the second actuator causes the first actuator to pivot about the first pivot axis to thereby release the first latch from the housing.

12. The vacuum cleaner of claim 11, wherein the second actuator comprises one or more first surfaces that slide on corresponding second surfaces on the first lid when the second force is applied to the second actuator, the first and second surfaces cooperating to pivot the first actuator about the first pivot axis.

13. The vacuum cleaner of claim 11, wherein the first force is directed towards the first lid, and the second force is directed away from the first lid.

14. The vacuum cleaner of claim 8, wherein application of a first force upon the second actuator releases the second latch from the second lid, and application of a second force, opposite the first force, on the second actuator releases the first latch from the housing.

15. The vacuum cleaner of claim 14, wherein the first force is directed towards the first lid, and the second force is directed away from the first lid.

16. The vacuum cleaner of claim 6, wherein the first latch comprises a first hook selectively engageable with a second hook on the housing.

17. The vacuum cleaner of claim 6, wherein the second latch comprises a third hook selectively engageable with a fourth hook on the second lid.

* * * * *

UNITED STATES PATENT AND TRADEMARK OFFICE

CERTIFICATE OF CORRECTION

PATENT NO. : 8,510,903 B2
APPLICATION NO. : 13/001471
DATED : August 20, 2013
INVENTOR(S) : Jubner et al.

It is certified that error appears in the above-identified patent and that said Letters Patent is hereby corrected as shown below:

On the title page, item (30) should read

(30) Foreign Application Priority Data

Jun. 27, 2008 (SE) 0801518-2

Signed and Sealed this
Fifteenth Day of October, 2013

Teresa Stanek Rea
*Deputy Director of the United States Patent and Trademark Office*